United States Patent [19]

Kazan

[11] Patent Number: 4,583,833

[45] Date of Patent: Apr. 22, 1986

[54] OPTICAL RECORDING USING FIELD-EFFECT CONTROL OF HEATING

[75] Inventor: Benjamin Kazan, Los Altos, Calif.

[73] Assignee: Xerox Corporation, Stamford, Conn.

[21] Appl. No.: 618,272

[22] Filed: Jun. 7, 1984

[51] Int. Cl.[4] ..... G03G 15/00

[52] U.S. Cl. ..... 355/9; 355/77; 430/50

[58] Field of Search ..... 355/9, 3 R, 77; 346/150; 430/50, 350, 351, 352

[56] References Cited

U.S. PATENT DOCUMENTS

| | | | |
|---|---|---|---|
| 3,175,196 | 3/1965 | Lee, Jr. et al. | 340/173 |
| 3,271,591 | 9/1966 | Ovshinsky | 367/173 |
| 3,284,196 | 11/1966 | Mazza | 430/50 |
| 3,382,780 | 5/1968 | Giaimo | 355/9 |
| 3,530,441 | 9/1970 | Ovshinsky | 340/173 |
| 3,542,545 | 11/1970 | Goffe | 355/9 X |
| 3,547,628 | 12/1970 | Wolff | 355/9 |
| 3,673,594 | 6/1972 | Kazan | 355/3 R |
| 3,677,750 | 7/1972 | Mammino et al. | 430/50 |
| 3,761,895 | 9/1973 | Ellis et al. | 340/173 CR |
| 3,764,311 | 10/1973 | Bean | 355/9 X |
| 3,795,514 | 3/1974 | Jvirblis et al. | 430/50 |
| 3,801,966 | 4/1974 | Terao | 340/173 LM |
| 3,868,651 | 2/1975 | Ovshinsky | 340/173 LS |
| 3,978,335 | 8/1976 | Gibbons | 250/320 |
| 3,983,542 | 9/1976 | Ovshinsky | 340/173 R |
| 3,988,720 | 10/1976 | Ovshinsky | 340/173 LS |
| 4,077,803 | 3/1978 | Gravel | 355/9 X |
| 4,183,094 | 1/1980 | Keezer et al. | 365/127 |
| 4,233,380 | 11/1980 | Moraw et al. | 430/50 |
| 4,320,489 | 3/1982 | Crandall et al. | 369/111 |

OTHER PUBLICATIONS

"Image-Storage Panels Based on Field-Effect Control of Conductivity", B. Kazan et al., Proceedings of the IEEE, Mar. 1968, vol. 56, No. 3, pp. 285-295.

"Optical Recording in Hydrogenated Semiconductors", M. A. Bosch, Applied Physics Letter, vol. 40, Jan. 1, 1982, pp. 8-10.

"The Kalvar Process", W. Seifert et al., Photographic Science and Engineering, vol. 5, No. 4, Jul.-Aug. 1961, pp. 235-238.

*Primary Examiner*—R. L. Moses

*Attorney, Agent, or Firm*—W. Douglas Carothers, Jr.

[57] ABSTRACT

To form an optical image, an imagewise pattern of conductivity is formed in a semiconductor material. Exposing the material to an intense radio-frequency field causes generation of heat in the conductive areas. The semiconductor is made of a heat-sensitive material or includes a heat-sensitive material. The heat-sensitive material responds to heat by physical changes which can be optically detected. Preferably the semiconductor is a photoconductor with surface charge capability retention which allows formation of a conductivity pattern by normal xerographic processes.

3 Claims, 3 Drawing Figures

OPTICAL RECORDING USING FIELD-EFFECT CONTROL OF HEATING

BACKGROUND OF THE INVENTION

This invention relates to imaging and particularly to imaging using the imagewise control of an intense radio-frequency field to change the physical characteristics of a material. The change in physical characteristics, for example, color, texture or phase, provides an image.

It is known that data recording can be obtained with a film of amorphous hydrogenated silicon or germanium, making use of the fact that the heating of local areas by a laser beam causes the material to bulge, swell or ablate resulting from hydrogen evolution at elevated temperatures (see "Optical Recording in Hydrogenated Semiconductors" by M. A. Bösch, Applied Physics Letters, Vol. 40, Jan. 1, 1981, pages 8–10).

Further, as shown in my U.S. Pat. No. 3,673,594, it is known that the magnetization of a material may be altered imagewise by the imagewise application of heat. In this patent, there is disclosed a process in which a zinc oxide layer is used to control the heat pattern generated by a radio-frequency field, the heat pattern corresponding to areas of the zinc oxide layer rendered conductive using xerographic techniques. Also, the patent discloses that a heat-sensitive material could be exposed to the pattern of heat generated by the zinc oxide layer resulting in an imagewise, viewable color change.

SUMMARY OF THE INVENTION

This invention provides a method for optical recording directly on a material by utilizing the imagewise control of a radio-frequency field to cause imagewise heating of a material. The material is chosen such that imagewise heating creates an optical pattern in the material. The imagewise control of heating results from a conductivity pattern formed by a field-effect action in the material using known xerographic charging and optical exposure techniques. The physical changes can be temporary, so that the material can be reused, or permanent, for archival uses.

The advantages of the invention will be made apparent upon reading the specification and particularly when the specification is read with reference to the drawings.

BRIEF DESCRIPTION OF THE DRAWINGS

The accompanying drawings are schematic representations of the steps of this invention and are not drawn to scale.

DESCRIPTION OF THE PREFERRED EMBODIMENTS

Figure 1:
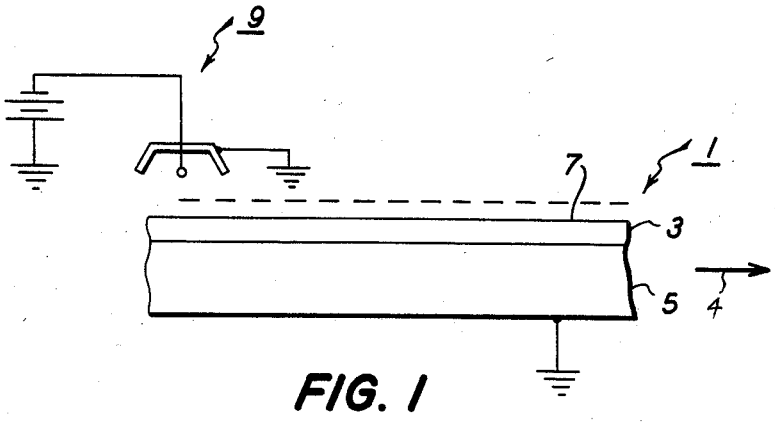
FIG. 1 shows the first step of the preferred embodiment which is to uniformly charge the surface of a photosensitive material.

Referring now to FIG. 1, there is shown optical recording structure generally designated 1 which, in this exemplary instance, is made up of electrically photosensitive layer 3 provided on resistive substrate 5. Resistive substrate 5 is formulated to have a slight amount of conductivity, the dielectric relaxation time of the substrate being, for example, of the order of a second. Electrically photosensitive layer 3 is a material whose physical appearance can be changed by the application of heat. As shown in FIG. 1, a free surface 7 of electrically photosensitive layer 3 is charged in the dark by passing it in the direction shown by arrow 4 under a source of electrical corona discharge shown generally as 9. In this exemplary instance, electrically photosensitive layer 3 is shown uniformly corona-charged to a negative potential. Since the photoconductor is assumed, in this example, to be of n-type material, it becomes internally charge-depleted by field-effect action, making it nonconducting. Resistive substrate 5 is grounded.

Figure 2:
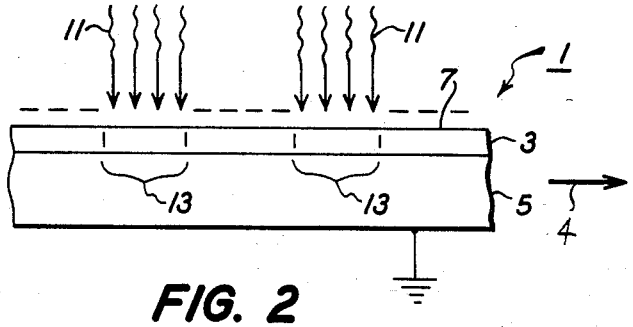
FIG. 2 shows the step of optically exposing the photosensitive material to form a conductivity pattern.

Referring now to FIG. 2, electrically photosensitive layer 3 is exposed to radiation 11, to which electrically photosensitive layer 3 is sensitive, in imagewise configuration. The radiation 11 may be, for example, light reflected from an original document to be copied or emissions from, for example, a computer controlled laser. The radiation 11 discharges exposed areas but leaves negative charges on the free surface 7 of electrically photosensitive layer 3 in unexposed areas. This results in the formation of relatively conductive regions 13 in electrically photosensitive layer 3 corresponding to radiation 11 exposed areas.

Figure 3:
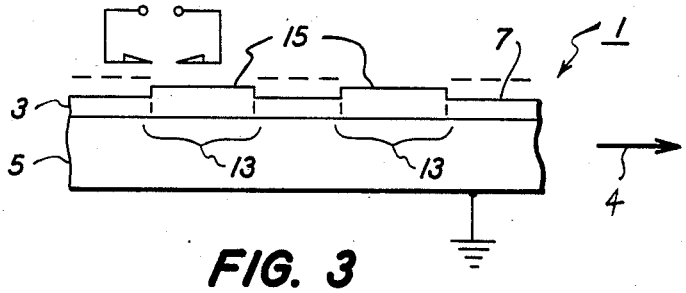
FIG. 3 shows the step of applying a radio-frequency electric field to successive portions of the electrically photosensitive material to cause physical change by heating.

Referring now to FIG. 3, optical recording structure 1 is passed under a source of intense radio-frequency field. The application of the radio-frequency field causes rapid heating in the relatively conductive areas 13 resulting in a physical change, here shown as raised areas 15 on electrically photosensitive layer 3. The physical change in this exemplary instance was a swelling of the electrically photosensitive material 3 in heated areas.

An example of a material which would respond as indicated above is amorphous hydrogenated silicon or germanium. An electrically photosensitive layer 3 of amorphous silicon doped with hydrogen can be formed on a substrate 5 of, for example, glass by glow discharge, sputtering, ion plating, ion implantation or other technique. Specific methods are shown, for example, in U.S. Pat. No. 4,265,991 to Hirai et al. The surface 7 of the electrically photosensitive layer 3 is then charged to a negative potential in the dark using a source of corona 9 of about 6000 volts. The surface 7 of electrically photosensitive layer 3 is then exposed to radiation 11 from a laser, the laser energy being about $10^{-6}$ J/cm$^2$ to produce the charge pattern as shown in FIG. 2. Portions of the surface 7 of electrically photosensitive layer 3 are then sequentially exposed to a radio-frequency field of sufficient intensity to cause rapid heating of the conductive areas of the photoconductor. The application of radio-frequency energy is continued for a time sufficient to cause swelling of the amorphous silicon layer 3 due to hydrogen evolution at the elevated temperature. These deformations or raised areas 15 can then be read, for example, optically, in a manner similar to that used for reading optical recording discs. In the case of an amorphous silicon layer heated directly by laser to evolve hydrogen, the energy requirement is on the order of about 0.1 J/cm$^2$. By comparison, in the case of the present invention, about five orders of magnitude less energy is required of the laser to produce a conductivity pattern. This allows the imagewise radiation 11 exposure to be conducted for a much shorter time. In the case of laser exposure, recording can be accomplished at a much higher speed, or much lower power lasers may be utilized.

Another example of a material which could be used for the photosensitive layer is a mixture of fine particles of photoconductive CdS, CdSe or ZnO in an insulating binder of Kalvar material. The diazonium salt contained in the latter material releases tiny amounts of nitrogen when uniformly exposed to UV radiation. When the layer is heated to about 115° C. (in this invention by the radio-frequency field controlled by the surface charge), local areas of the Kalvar will form microscopic bubbles because of the expansion of the nitrogen, resulting in deformation of the layer.

Another alternative is to mix the CdS or CdSe photoconducting particles with an insulating binder of the material commonly used in thermal printing paper. This material (for example, a triphenylmethane derivative, bis-phenol A and polyvinyl alcohol) turns dark when heated to about 100° C.

Although a specific set of materials and operating conditions was specified, other materials and operating conditions could be utilized. For instance, other materials can be used in electrically photosensitive layer 3 to provide an image. For example, electrically photosensitive layer 3 can include materials which will sublime, evaporate, change color or reflectivity upon heat application. Further, materials can be utilized which, for example, crystallize or otherwise change phase in a visible manner. Such modifications can be considered as included as defined in the following claims.

What is claimed is:

1. A method of recording on a recording element having a charge retentive, photosensitive layer on a substantially insulating substrate, said layer characterized by having a property of releasing a gas upon exposure to a sufficient amount of heat in areas thereof not retaining a charge and comprising the steps of (1) electrostatically charging a free surface of said recording element layer to provide a uniform electrostatic charge thereon, (2) exposing said layer to a pattern of light radiation of sufficient magnitude to selectively discharge areas of said layer in imagewise configuration according to said pattern, (3) scanning with radio-frequency radiation source linearly across said free surface to sequentially expose said free surface to rapid localized heat causing said discharged areas to swell outwardly from said free surface due to the evolution of said gas, the remaining charged areas of said surface not heated to the same degree as said discharged areas due to the presence of said charge whereby the optical appearance of said imagewise pattern is produced on said free surface.

2. The method of optical recording of claim 1 wherein said material is amorphous hydrogenated silicon or germanium.

3. The method of optical recording of claim 1 wherein said material is CdS or CdSe or ZnO mixed with a suitable insulating binder.

* * * * *